US005621422A

United States Patent [19]

Wang

[11] Patent Number: 5,621,422

[45] Date of Patent: Apr. 15, 1997

[54] SPIRAL-MODE MICROSTRIP (SMM) ANTENNAS AND ASSOCIATED METHODS FOR EXCITING, EXTRACTING AND MULTIPLEXING THE VARIOUS SPIRAL MODES

[75] Inventor: Johnson J. H. Wang, Marietta, Ga.

[73] Assignee: Wang-Tripp Corporation, Marietta, Ga.

[21] Appl. No.: 293,668

[22] Filed: Aug. 22, 1994

[51] Int. Cl.[6] ..... H01Q 1/36

[52] U.S. Cl. ..... 343/895; 343/700 MS

[58] Field of Search ..... 343/895, 700 MS, 343/846, 792.5, 829, 740, 853, 857; H01Q 1/36

[56] References Cited

U.S. PATENT DOCUMENTS

| | | | |
|---|---|---|---|
| 3,343,089 | 9/1967 | Murphy et al. | 343/895 |
| 3,509,465 | 4/1970 | Andre et al. | 343/895 |
| 4,410,891 | 10/1983 | Schaubert et al. | 343/700 MS |
| 5,220,340 | 6/1993 | Shatai | 343/895 |
| 5,223,849 | 6/1993 | Kasevich et al. | 343/895 |
| 5,313,216 | 5/1994 | Wang et al. | 343/895 |
| 5,351,063 | 9/1994 | Kim et al. | 343/895 |

OTHER PUBLICATIONS

Walker et al, "Superconducting Superdirectional Antenna Arrays" IEEE Transactions on Antennas and Propagation, vol. AP–25, No. 6, Nov. 1977, pp. 885–887.

*Primary Examiner*—Hoanganh T. Le
*Attorney, Agent, or Firm*—Hopkins & Thomas

[57] ABSTRACT

A first spiral-mode microstrip (SMM) antenna has an antenna element situated over and spaced from a parallel ground plane. The antenna element is a frequency-independent planar structure having a plurality of spiraling arms extending outwardly in a plane from a central portion, the arms having respective feed points to excite the spiral modes. Of particular significance, a shorting mechanism connects one or more arms to the ground plane element for influencing the shape of the electromagnetic radiation pattern. A second embodiment of the SMM antenna is constructed as the first, but has a center feed and an off-center feed, and further comprises shorting mechanisms situated well within the periphery of the antenna element. A third embodiment of the SMM antenna is constructed similar to the first, but has a concentric gap situated within the arms so that there is, in effect, a first antenna element having a first plurality of arms and a second concentric antenna element having a second plurality of arms. Capacitors, inductors, and electrical/mechanical switches can be included in the shorting mechanism to facilitate multi-mode, multi-function, and/or broadband operations. By recognizing that the SMM antenna is equivalent to a slot antenna or a magnetic current antenna, a super-thin fourth SMM antenna can be constructed and is a fourth embodiment of the present invention. In this super-thin antenna, the distance between the antenna element and the ground plane is less than or equal to 0.03 of the geometric mean wavelength of the operating band.

26 Claims, 8 Drawing Sheets

SPIRAL-MODE MICROSTRIP (SMM) ANTENNAS AND ASSOCIATED METHODS FOR EXCITING, EXTRACTING AND MULTIPLEXING THE VARIOUS SPIRAL MODES

FIELD OF THE INVENTION

The present invention generally relates to antennas for electromagnetic radiation, and more particularly, to improved spiral-mode microstrip (SMM) antennas with multimode, or multifunction, capabilities, and methods for exciting, extracting, and multiplexing the various spiral modes, each mode being characterized by an associated electromagnetic radiation pattern.

BACKGROUND OF THE INVENTION

Because of the continuing proliferation of wireless electronic systems installed on structures, such as cars, trucks, boats, aircraft, missiles, and human bodies, and because of the limited availability of surface area suitable for antenna mounting on these structures, there is a rapidly growing need in the industry to reduce the size and the number of antennas which are mounted on these structures. One approach to reduce the number of antennas is to implement a multimode, or multifunction, antenna, which can handle two or more wireless electronic systems concurrently. However, there are only a few multifunction antennas known in the industry today, and they are mostly of the type having high-directivity (i.e., high gain in particular directions). Furthermore, these few antennas are not conformal and low-profile, and therefore take up considerable space when mounted on a vehicle or structure.

To achieve multifunction operation, an antenna generally needs (1) a wide, though not necessarily continuous, frequency bandwidth, and (2) diversity of the radiation pattern and polarization. Very few antennas have these properties. Requirements (1) and (2) arise from the fact that different electronic systems operate at different frequencies and require different radiation patterns and polarizations.

The need for surface conformability, or the ability to shape an antenna to suit a particular application, is based primarily upon practical considerations, not upon the electrical performance of the antenna. More specifically, for aircraft or missiles, for instance, aerodynamic considerations dictate that an antenna have a low profile with little or no protrusion from or into the body of these devices. For the automobile, as another example, the need for protection against breakage, vandalism, damage in a car wash, etc., and the desire for privacy, security, or aesthetic appeal motivate car manufacturers to attempt to develop antennas which can be integrated into the rooftop structure as a hidden antenna.

As for conformability, very few antennas can claim this feature. A review of existing antennas in the art quickly reveals that there is no known antenna that has both surface conformability and a bandwidth of over 30%, except for the spiral-mode microstrip (SMM) antenna recently invented by J. J. H. Wang (also the inventor herein) and V. K. Tripp, as set forth in U.S. Pat. No. 5,313,216.

Although the SMM antenna of U.S. Pat. No. 5,313,216 is potentially capable of generating various modes, it is not a trivial matter to excite, extract, and multiplex one or more modes from a single SMM antenna. This problem could be handled by using a complex feed matrix, such as a Butler matrix, which is well known in the art, or the feed network originally designed for the cavity-loaded spiral antenna described in R. G. Corzine and J. A. Mosko, *Four-Arm Spiral Antennas*, Artech House, Norwood, Mass., 1990. However, the foregoing feed networks are undesirably complex, bulky, and expensive. Accordingly, a heretofore unaddressed need exists in the industry for improved methods for exciting, extracting, and generating various SMM antenna modes with much less complexity, requisite space, and expense as compared to the prior art.

SUMMARY OF THE INVENTION

Briefly described, the present invention involves improved spiral-mode microstrip antennas and associated methods for exciting, extracting, and multiplexing various spiral modes in single-mode, or multi-mode (multi-function) spiral-mode microstrip antennas.

In a first embodiment of the present invention, a spiral-mode microstrip antenna is designed to have optimized gain and specific angular coverage. The basic configurations of the SMM have been described in U.S. Pat. No. 5,313,216 and other related pending applications. The SMM antenna comprises a generally planar ground plane element disposed below a frequency-independent antenna element. The antenna element has a plurality of arms extending outwardly in a plane from a central portion. The arms have respective feed points. The plane of the antenna element is generally parallel to and spaced from the ground plane element. The antenna element can be excited to generate one or more spiral modes for certain electromagnetic radiation patterns needed for specific operations. Of particular significance, a shorting mechanism connects one or more of the arms to the ground plane element for modifying the electromagnetic radiation pattern to enhance a mode of operation (for instance, mode-0). The shorting mechanism can be a conductive pin, or some other suitable electroconnection, and the shorting mechanism may additionally comprise a capacitor, an inductor, and/or a switching mechanism, such as a diode, for further optimization of its operation as described herein. Thus, an advantage of the shorting mechanism is that it can be used to achieve the desired high gain at angles near the ground plane while the antenna operates in mode-0.

In a second embodiment of the present invention, a spiral-mode microstrip antenna is constructed just as the first embodiment, but has one feed centrally located and another feed at an off-center location. Further, the second embodiment comprises shorting mechanisms situated either at or well within the periphery of the antenna element. The foregoing features influence the shape of radiation patterns and facilitate multimode operation.

In a third embodiment of the present invention, a spiral-mode microstrip antenna is provided for optimizing radiation patterns for a plurality of spiral modes. The microstrip antenna has a generally planar ground plane element. A first antenna element is disposed over the ground plane element and has a first plurality of arm portions spiralling outwardly from a central portion of the first antenna element within a plane. The arm portions have respective feed points. The plane of the antenna element is generally parallel to and spaced apart from the ground plane element. The antenna element is properly excited for a specific spiral mode. Furthermore, a second antenna element is situated within the plane and is concentric with but separated from the first antenna element. The second antenna element has a second plurality of arm portions spiralling outwardly from the central portion within the plane. In essence, the configuration can be viewed as a concentric gap within an antenna element having a spiraling pattern. This gap limits the propagation of spiral modes to within either the outer or inner spiral windings, which contain different radiation zones associated with different spiral modes or different frequencies. Without the gap, a spiral mode could travel extensively, and thus be dissipated, along the spiral windings without much of the desired radiation. With the gap, a spiral mode travels within a much reduced region containing the relevant radial zone and thus has more opportunity to radiate each time it passes the appropriate radiation zone.

In a fourth embodiment of the present invention, a super-thin, low profile, spiral-mode microstrip antenna is provided. The super-thin, low profile microstrip antenna has a generally planar ground plane element and an antenna element situated over the ground plane element. The antenna element is a frequency-independent structure having a plurality of arm portions extending outwardly in a plane from a central portion, said arm portions having respective feed points. The ground plane is finite but must be at least as large as the antenna element. The plane of the antenna element is generally parallel to and spaced from the ground plane element by a distance. The distance is less than or equal to $0.03\lambda_c$, about $0.01\lambda_c$ in a preferred embodiment, where $\lambda_c$ is the wavelength at the geometric mean frequency between the minimum and maximum operating frequencies. This super-thin antenna has a variety of potential applications due to its compactness and low profile.

In a fifth embodiment, superconductivity material is used for the metallic surface of the antenna and the dielectric material of the antenna is either removed or replaced by the low-loss type. This approach enhances the efficiency of the antenna, especially for the super-thin type.

Other features and variations of the present invention will become apparent to one of skill in the art upon examination of the following drawings and detailed description. In particular, the Frequency Scaling Theory of antenna theory allows one to extend the frequencies of operation to a different domain by scaling the dimensions, permittivity, conductivity, etc. As a consequence of the Reciprocity Principle, the antenna can function either as a transmit antenna or as a receive antenna, or both simultaneously, unless nonreciprocal device or material is used in the construction. All such additional features and variations are intended to be included herein within this disclosure and the scope of the present invention.

BRIEF DESCRIPTION OF THE DRAWINGS

The present invention can be better understood with reference to the following drawings. The drawings are not necessarily to scale, emphasis instead being placed upon clearly illustrating principles of the present invention.

FIG. 1 shows a top view thereof; FIG. 2A shows a side view thereof with two coaxial cables feeding the two spiral arms; and FIG. 2B shows a partial exploded side view thereof;

FIG. 6A shows a top plan view; FIG. 6B shows a front side view with feed point and conductive pin shorting mechanism; FIG. 6C shows a partial side view with a shorting mechanism having a capacitance C; FIG. 6D shows a partial side view with a shorting mechanism having a inductance L; and FIG. 6E shows a partial side view with a shorting mechanism having a switchable diode D;

FIG. 8A shows the VSWR of a 2-arm SMM antenna with spiral diameter D=3.0 inches and thickness d=0.7 inches, and FIG. 8B shows the VSWR of a 2-arm SMM antenna with spiral diameter D=24 inches and thickness d=0.7 inches;

DETAILED DESCRIPTION OF THE PREFERRED EMBODIMENT

Figure 1:
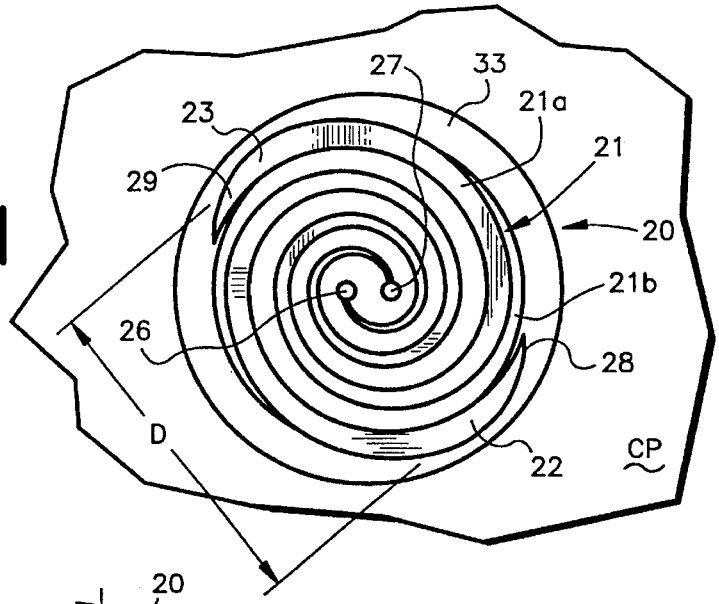
FIGS. 1, 2A , and 2B show a 2-arm, equiangular spiral mode microstrip (SMM) antenna; specifically.
Figure 2A:
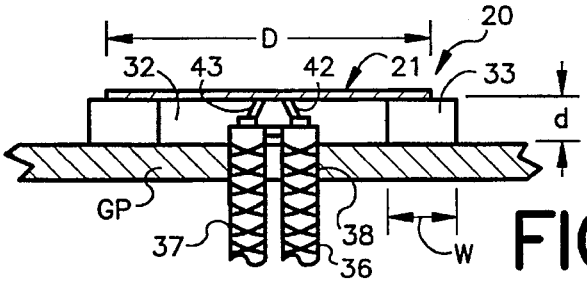
Figure 2B:
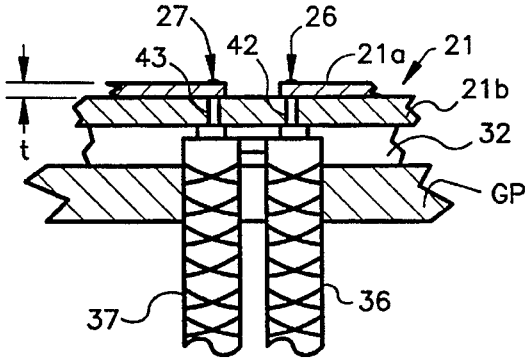

Referring now to the drawings wherein like reference numerals designate corresponding parts throughout the several views, FIGS. 1, 2A and 2B show a spiral-mode microstrip (SMM) antenna 20, according to a preferred form as set forth in U.S. Pat. No. 5,313,216 to Wang et al. The disclosure of U.S. Pat. No. 5,313,216 is incorporated herein by reference as if set forth in full hereinbelow. For purposes of discussion and for a better understanding of the present invention, the antenna 20 and its operation for a mode-1, as an example, will be briefly described hereafter. Furthermore, although U.S. Pat. No. 5,313,216 describes other embodiments of the SMM antenna, for the sake of simplicity, only the preferred embodiment is described hereafter, and it should be noted that the principles of the present invention are applicable to all embodiments of the SMM antenna.

The SMM antenna 20 includes an antenna element 21 comprising a very thin metal foil 21*a*, such as a copper foil, and an optional thin dielectric backing 21*b* which may be desirable for construction by chemical etching. The antenna element foil 21*a* shown in FIGS. 1, 2A and 2B is a planar frequency-independent antenna such as a spiral, which includes first and second spiral arms 22 and 23. Spiral arms 22 and 23 originate at terminals 26 and 27 roughly at the center of antenna element 21. The spiral arms 22 and 23 spiral outwardly from the terminals 26 and 27 about each other and terminate at tapered ends 28 and 29, thereby roughly defining a circle having a diameter D and a corresponding circumference of πD. The antenna element foil 21*a* is formed from a thin metal foil or sheet of copper by any of well known means, such as by machining, stamping, chemical etching, etc. Antenna element foil 21*a* has a thickness t of approximately less than 10 mils, although other thicknesses obviously can be employed as long as it is thin in terms of the wavelength, say for example, 0.001 wavelength or less, but not too thin to provide the needed skin depth. The SMM antenna 20 can be constructed with or without its own ground plane since the mounting vehicle may have a conducting surface, making the antenna suitable for mounting on either conducting or non-conducting surfaces, e.g., metal or non-metal vehicles.

The thin antenna element 21 and the ground plane GP are flexible enough to be mounted to any ordinary contoured surface, although in FIGS. 2A and 2B the antenna element and the ground plane are represented as being planar. The antenna element foil 21*a* is uniformly spaced a selected distance d, the "stand-off distance," from the ground plane GP. A dielectric spacer 32 is positioned between the antenna element 21 and the ground plane GP, serving mainly as a spacer. The dielectric spacer 32 preferably has a low dielectric constant, in the range of 1 to 4.5, as will be discussed in more detail below. The dielectric spacer 32 is generally in the form of a disk but can be of any shape or size; its main function is to maintain the spacing between the ground plane GP and the antenna element 21. The thickness d of the dielectric spacer 32 (distance between antenna element 21 and the ground plane GP) is typically much greater than the thickness of the optional dielectric backing 21*b*, which is usually associated with the antenna element 21 in the form of a substrate useful in the fabrication process. The thickness d of spacer 32 typically is in the neighborhood of 0.1" to 0.3" if a wide frequency range of 2–18 GHz must be covered. However, the specific thickness chosen to provide a reasonable gain for a given frequency should be less than one-half of the wavelength in the medium of the dielectric spacer.

A loading 33 comprising a microwave absorbing material, such as carbon-impregnated foam, in the shape of a ring is optionally positioned concentrically about dielectric spacer 32 and extends partially beneath antenna element 21. Alternatively, a paint laden with carbon can be applied to the outer edge of the antenna element to improve the quality of the radiation pattern. Also, the antenna element can be provided with a peripheral shorting ring positioned adjacent and just outside the spiral arms 22, 23 and the peripheral shorting ring (unshown) can be painted with the carbon-laden paint. The loading introduces both loss and increased production cost, and is generally not used unless high-quality radiation patterns are required.

First and second coaxial cables 36, 37 extend through an opening 38 in the ground plane GP for electrically coupling the antenna element 21 with a feed source, driver, or detector depending on whether the antenna is used to receive, or transmit, or both. The reciprocity theorem in electromagnetics and antenna theory dictates that an antenna such as the SMM antenna can be used for both transmit and receive, unless non-reciprocal material is used in the antenna. The coaxial cables 36, 37 are respectively connected with the terminals 26, 27 by the center conductors 42 and 43. The outer shields of the coaxial cables 36, 37 are electrically connected to each other in the vicinity of the antenna element 21, as shown in FIG. 2B. As shown schematically in FIG. 3, this electrical connection of the shielding of the coaxial cables 36, 37 can be accomplished by soldering a short conducting wire 44 at its ends to each of the coaxial cables 36, 37.

Figure 3:
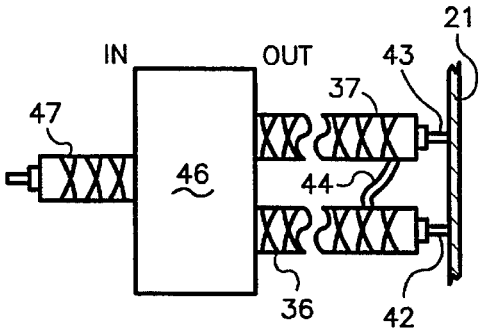
FIG. 3 shows a feed network for driving the antenna of FIG. 1.

As shown in FIG. 3, the coaxial cables 36, 37 may be connected to a conventional RF hybrid unit 46 which is in turn connected with a single coax cable input 47. The function of the RF hybrid unit 46 is to maintain either a 0 degree or a 180 degree phase-shift, for mode-0 and mode-1, respectively, between the signals on coaxial cables 36, 37. In the mode-1 case, two signals of equal amplitude, but phase-shifted 180° relative to each other, are fed to the two antenna element arms 28, 29 by generating a voltage potential across the terminals 26, 27. This voltage potential corresponds to a waveform carried along the coaxial cables 36, 37 and 47, causing the antenna to radiate primarily in a mode-1 (FIG. 4 hereafter; although some components of higher-order modes can be present); or alternatively, this voltage potential corresponds to an analogous waveform received by the arms 28, 29. When the output of the hybrid leads to equal amplitude and phase between feed points 26 and 27, the mode-0 is excited.

As an alternative for mode-1 excitation, a conventional balun may be used. A more complex RF hybrid circuit 46 can also be used for generating higher-order operational modes (e.g. i=2, 3 in FIG. 4). However, for generating these higher-order modes, 4, 6, or 8 antenna element arms are generally needed in conjunction with a corresponding number of feed terminals.

Figure 4:
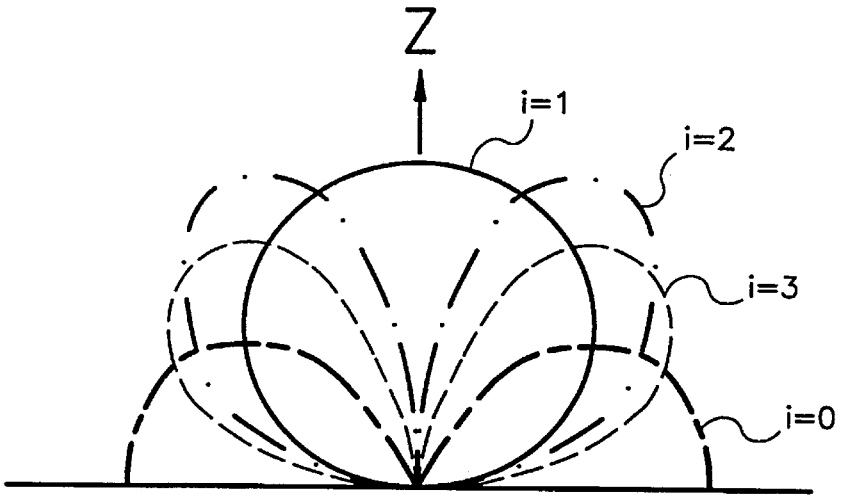
FIG. 4 shows elevation radiation patterns of four possible spiral modes (i.e., modes zero through three, i=0,1,2,3) radiated from an SMM antenna.

FIG. 4 shows four of the possible radiation patterns of spiral modes, which are denoted i=0, 1, 2, and 3, with i being the mode number, corresponding to the SMM antenna. The foregoing modes generally cover the basic pattern requirements for most telecommunication and other electronic systems. In FIG. 4, the z-axis is perpendicular to the spiral arms 28, 29 and the ground plane GP of the SMM antenna 20. FIG. 4 illustrates the radiation patterns for the corresponding spiral modes which are inherent in the SMM antenna, but which must be excited, extracted, and multiplexed in practical applications. The present invention provides for novel techniques to excite, extract, and multiplexing one or more spiral modes (e.g., i=0, 1, 2, 3) in the SMM antenna in an efficient and low-cost manner.

In addition to multimode, or multifunction SMM antenna applications, the techniques can be used in a single-mode SMM antenna to reduce its size and cost and/or to improve its performance. The techniques can further be used to construct super-thin SMM antennas.

Finally, the techniques of the invention can be used to enhance the antenna gain for mode-0 operation at angles near the ground plane. This provides a major advantage for the SMM antenna over the competing annular slot and transmission-line antennas, which are the only other conformal, low-profile antennas with radiation patterns similar to those of the dipole or monopole, yet suffer from an elevation tilt resulting in a low gain near the ground plane. In addition, the annular slot and the transmission-line antenna are narrow-banded and are more protruding structures.

Figure 5A:
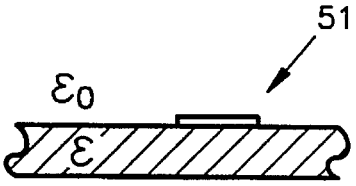
FIGS. 5A through 5D show transmission line models for the SMM antenna such as that of FIG. 1: the microstrip line model in FIG. 5A, the coupled microstrip line model in FIG. 5B, the slot line model in FIG. 5C, and the coplanar waveguide model in FIG. 5D.
Figure 5B:
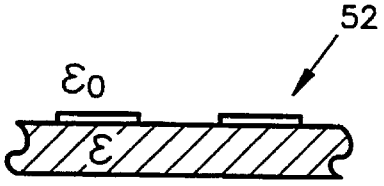
Figure 5C:
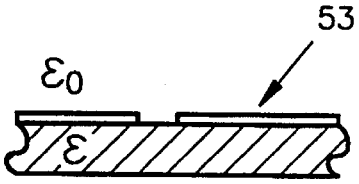
Figure 5D:
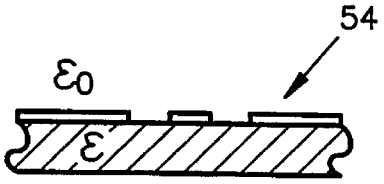

The specific techniques of the present invention are partially based on the observation that a properly designed SMM antenna 20 can be viewed for purposes of design and analysis as any one or more of the following conventional transmission lines, which are well known in the art: a microstrip line 51 as shown in FIG. 5A, a coupled microstrip line 52 as shown in FIG. 5B, a slot line 53 as shown in FIG. 5C, and a coplanar waveguide 54 as shown in FIG. 5D.

The spiral structure of the SMM antenna 20 is usually of the self-complementary type. A self-complementary planar structure is one in which the metal portion (arms 22, 23 in the two-arm case) is a mirror image of the non-metal portion (region exposed between arms 22, 23 in the plane of the spiral). A self-complementary plane is particularly suitable for broadband operations, because a self-complementary planar structure has a constant non-reactive impedance which is independent of frequency. Since the spiral winding, such as the self-complementary Archimedean type, together with the ground plane can be viewed as one or more of the four transmission lines 51–54 (FIG. 5), an electromagnetic wave can propagate along the spiral windings in a broadband and well-matched manner. An electromagnetic wave propagating along the spiral arms (22, 23 in the two-arm case) can radiate in one of the spiral modes i when the appropriate conditions exist.

In general, the microstrip line 51 of FIG. 5A supports well the propagation of a mode-0 wave, and the other three transmission lines 52, 53, 54 of respective FIGS. 5B, 5C, 5D are compatible with the remaining spiral modes-1, 2, 3. The aforementioned properties can be used to facilitate proper excitation of the desired modes.

Based upon the well known Current Equivalence Principle, the SMM antenna 20 can be viewed as a magnetic current source which is equal to $-n\times E$ (bold text signifies a vector herein) over a conducting surface covering the entire surface of the antenna, where n is an outward unit normal vector perpendicular to the antenna surface at the point of interest, and E is the electric field vector at this point. Such a magnetic current exists only at the nonmetallic portion of the surface, because $-n\times E$ vanishes on the conducting surface of the metallic spiral arms and the ground plane GP. The magnetic current is more compatible with a conducting surface than the electric current; this explains why conformal, low-profile antennas are all of the magnetic current type (for example, slot antennas and microstrip patch antennas, the latter of which are described in U.S. Pat. No. RE 29,911 to Munson). The SMM antenna 20 can also be viewed as a magnetic current antenna (or slot antenna); and this is why the SMM antenna 20 is conformal and low-profile.

Specific novel techniques in accordance with the present invention for constructing improved SMM antennas and for exciting, extracting, and multiplexing various spiral modes are presented in detail hereafter.

USE OF SHORTING MECHANISM(S) TO EXCITE MODE-0

The inventor has discovered that by connecting the spiral arms 22, 23 and the ground plane GP with one or more shorting mechanisms at proper locations, the mode-0 radiation pattern (FIG. 4) can be improved to have the desirable feature of a maximum gain at angles near the ground plane GP. The shorting mechanisms are essentially connections between the arms, such as 22, 23 in the two-arm case, of the antenna element 21 and the ground plane GP for establishing a short-circuit or similar connection. The shorting mechanisms are preferably conductive pins, but may be any suitable electrical connection, and may include an inductance or a capacitance for further variance of the radiation property as will be further discussed hereinafter. The shorting mechanism may also include a switching mechanism, for instance, a semiconductor switching device, which can be controlled for selectively and/or dynamically shorting and unshorting the antenna element 21 at desired locations. Furthermore, in many applications, a single shorting mechanism is sufficient, and it is not necessary to short every spiral arm of the spiral antenna element 21.

The inventor also discovered that the shorting mechanism is also useful for shaping the radiation patterns of other spiral modes. For instance, the beam width of mode-1 pattern can be broadened, and the gain of mode-2 and mode-3 patterns at angles near the ground plane can be enhanced, as are often desired.

Figure 6A:
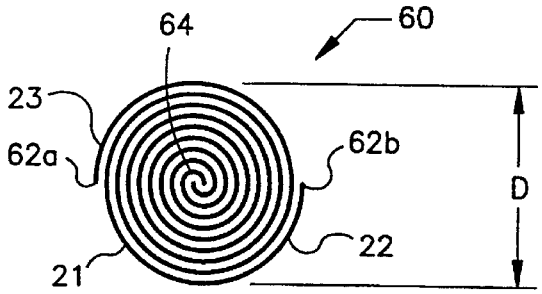
FIGS. 6A through 6E show a first embodiment of an SMM antenna of the present invention, which utilizes a center feed point and novel shorting mechanisms; specifically.
Figure 6B:
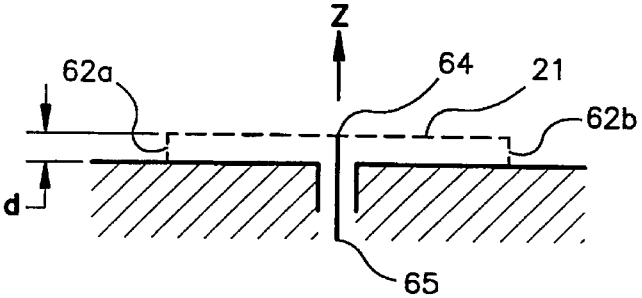

FIGS. 6A and 6B show an SMM antenna 60, as an example, which is a center-fed, mode-0, SMM antenna with a 2-arm Archimedean spiral having a spiral diameter D=3.0" and an antenna element to GP spacing d=0.375" . The ground plane can be and is often as large as needed or desired. The SMM antenna 60 of FIGS. 6A and 6B has a single feed point 64. Also, just like the SMM antenna 20 of FIG. 1, a mode-0 excitation can be achieved in the SMM antenna 60 by feeding all arms with the same voltage, in both amplitude and phase. Note that in FIG. 6B only the center conductor of the coaxial feed 65 extends above the ground plane GP. In a particular design, the SMM antenna 60 of FIGS. 6A and 6B can be used to cover the frequency range of 800–900 MHz if d is about 0.375 inch and D is about 3.0 inches, which includes the conventional cellular frequencies, among others. Shorting devices 62*a* and 62*b*, which may be shorting pins, connect the antenna 60 to the ground plane GP.

Although the ground plane GP of the SMM antennas 20, 60 is ideally infinite in extent, it can be as small as the diameter D (FIG. 1) of the spiralling antenna element 21 in many applications.

Figure 6C:
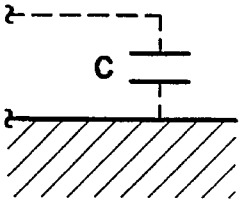
Figure 6D:
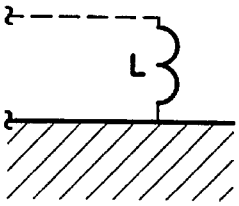
Figure 6E:
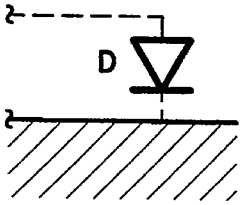

As mentioned previously, the SMM antenna 60 of FIGS. 6A and 6B may further include, in the place of shorting pins, or in addition thereto, an inductance or a capacitance for further variance of the radiation property, as shown by an inductor L and a capacitor C in FIGS. 6C and 6D, respectively. The shorting mechanism may also include a switching mechanism, for instance, a semiconductor switching device, which can be controlled for selectively and/or dynamically shorting and unshorting the antenna element 21 at desired locations. A suitable switching device would be a diode D, configured as illustrated in FIG. 6E. In the configuration of FIG. 6E, the diode D would be selectively biased and unbiased with a voltage source (not shown) so as to actuate the diode's conductivity.

In another variation of the SMM antenna 60 of FIG. 6, the spiral antenna element 21 can be increased in diameter D to as large as 12", while maintaining the shorting mechanisms 62*a*, 62*b* at approximately 1.5" from the antenna center as shown to achieve better antenna performance at the 800–900 MHz frequencies. This version with a large spiral is particularly desirable for multifunction applications, in which the outer spiral is employed to radiate other spiral modes generally at other frequencies.

Figure 7A:
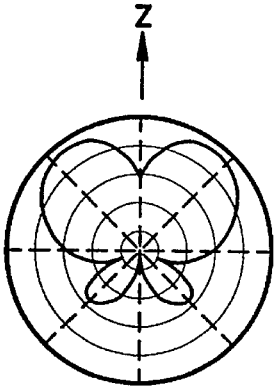
FIGS. 7A and 7B show elevation radiation patterns for mode zero of FIG. 1 without and with the shorting mechanisms of FIG. 6, respectively.
Figure 7B:
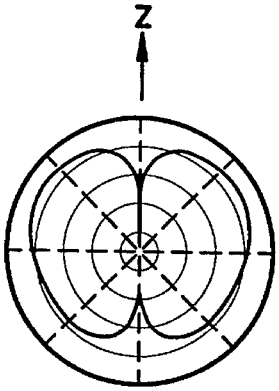

For purposes of comparison, FIGS. 7A and 7B illustrate typical elevation radiation patterns in the cellular band for the SMM antenna 60 without and with shorting mechanisms, respectively. Extensive measurements have shown that the shorting mechanisms 62*a*, 62*b* typically increase the desired antenna gain at the horizon (near the ground plane GP parallel to earth) by about 10 dB, mainly by moving the pattern tilt from a high elevation angle toward the horizon, as shown in FIGS. 7A and 7B.

The optimal location of the shorting mechanisms 62*a*, 62*b* is not limited to the one in FIGS. 6A and 6B, but is generally determined by individual design goals. Moreover, the two shorting mechanisms 62*a*, 62*b* do not have to be of equal distance from the center of the spiral antenna element 21. In fact, unequal distances from the spiral center for the two shorting mechanisms 62*a*, 62*b* can be chosen for other advantages such as better bandwidth or pattern performance. A predominant factor in determining the optimal location of a shorting mechanism is its distance from the feed point along the spiral winding, which is generally larger than one-quarter wavelength. The location of the shorting mechanism is easily optimized by using modern instrumentation such as the network analyzer and the associated antenna pattern recorder.

The spiral element 21 can have three, four, or more arms for other advantages. However, the two-arm Archimedean spiral has been observed to be easier to match in impedance than the four-arm spiral for ordinary feed lines.

It is further observed that the shorting mechanisms 62*a*, 62*b* play a dominant, though not necessary, role in mode-0 radiation. As a result, another mode-0 wave at a lower frequency can be enhanced by placing another set of shorting mechanisms at an appropriate outer ring of the spiral antenna element 21. In other words, mode-0 radiation at two different frequencies can be enhanced by two respective shorting mechanisms, low frequency radiation being near the outer ring and high frequency radiation being near the inner ring.

The shorting mechanisms 62*a*, 62*b* can also serve as a lightning protection measure by channelling the lightning current to the ground plane GP through the shorting mechanisms 62*a*, 62*b*. This feature would protect the devices below the feed point(s) and elsewhere.

Figure 8A:
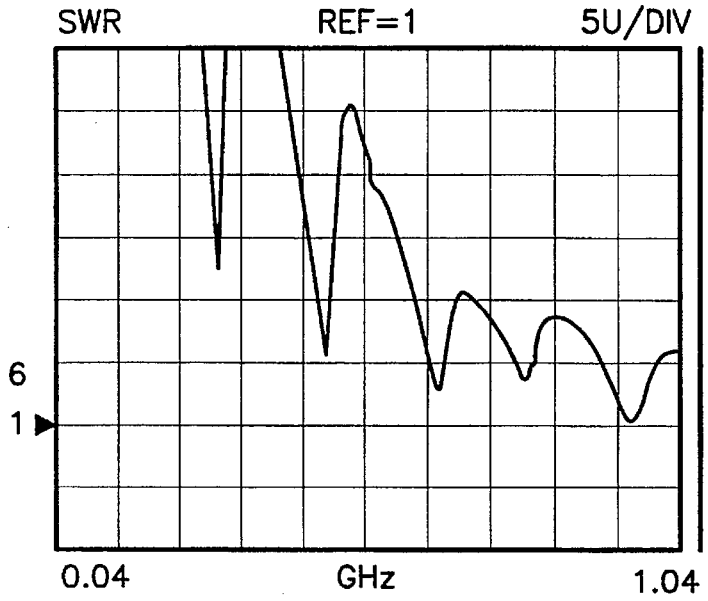
FIGS. 8A and 8B show the measured VSWR of the SMM antenna of FIG. 6 with the shorting mechanisms; specifically.
Figure 8B:
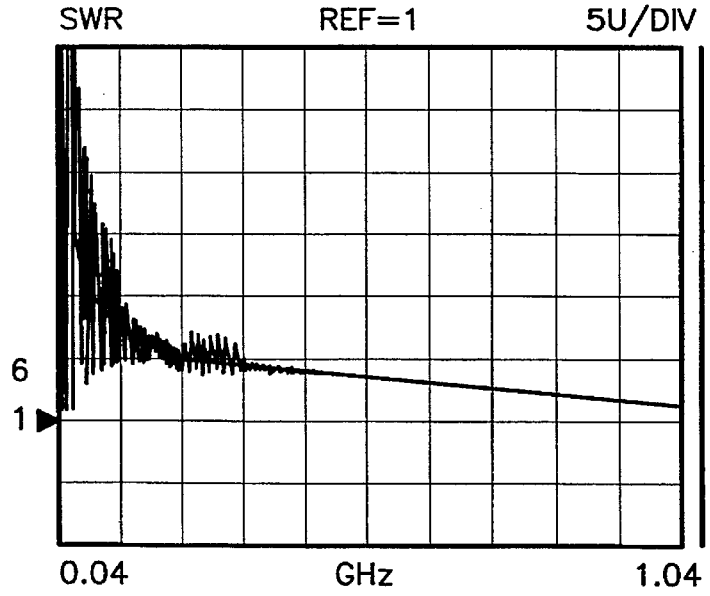

The robust nature of the shorting mechanism technique for mode-0 enhancement in the SMM antenna 60 is demonstrated in FIGS. 8A and 8B. FIGS. 8A and 8B show the measured broadband VSWR (voltage standing-wave ratio) of the SMM antenna 60 of FIG. 6 with the shorting mechanisms 62*a*, 62*b*. Specifically, FIG. 8A shows the VSWR of 2-arm SMM antenna with spiral diameter D=3.0" and thickness d=0.7", and FIG. 8B shows the VSWR of a 2-arm SMM antenna with spiral diameter D=24" and thickness d=0.7". As expected, the diameter D of the spiral antenna element 21 sets the lower boundary of the frequency range of operation. The impedance matching can be significantly improved over a multioctave band and can be made near perfect over any narrower, but practical, bands of, say, 10%.

To broaden bandwidth, "fat" shorting structure can be utilized in a manner similar to those practices found to be effective in broadening the bandwidth of the monopole antenna. The use of a "fat" structure to broaden bandwidth has been amply documented for wire antennas, dipoles, monopoles, for which biconical antennas, triangular fan antennas, fat dipole, etc. are their "fat" versions with broadened bandwidth.

MULTIMODE (MULTIFUNCTION) OPERATIONS USING SHORTING MECHANISMS

The use of shorting mechanisms 62*a*, 62*b* (FIG. 6) to excite mode-0 is generally compatible with the excitation of other spiral modes of operation, particularly modes-1, 2, 3, in the same frequency band. Furthermore, the use of shorting mechanisms 62*a*, 62*b* to excite mode-0 is also generally compatible with nearly all spiral modes, including mode-0, in other frequency bands.

Figure 9:
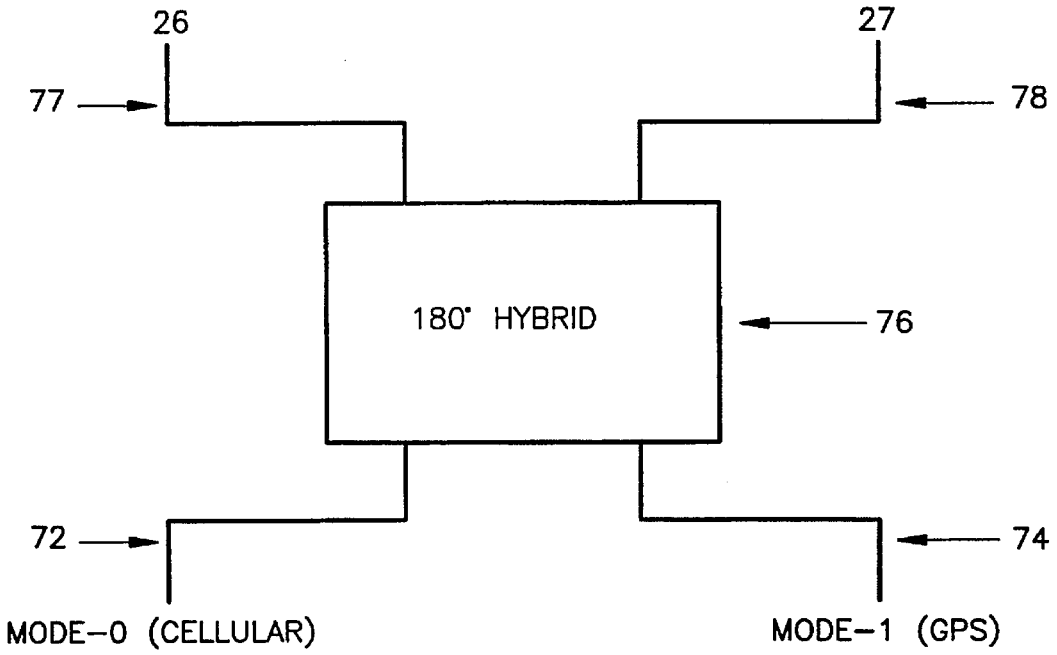
FIG. 9 is a schematic diagram of a 180° hybrid for dual mode excitation for the SMM antenna of FIG. 6.

As an example, the single coaxial feed in FIG. 6 can be replaced by two separate coaxial feeds carrying different signals, one connected to each of the two spiral arms 22, 23, as shown in FIG. 9. As illustrated in FIG. 9, a mode-0 output 72 carries, for example, the cellular band of frequencies, and a mode-1 output 74 carries, for example, the GPS (Global Positioning System) band of frequencies. The outputs 72, 74 are both connected to a 180°-hybrid feed network 76 covering both bands, which is well known in the art. Further, connections 77, 78 are connected to the respective spiral arms 22, 23 and communicate the respective cellular and GPS frequencies to and from the antenna element 21. The mobile cellular phone needs a mode-0 pattern similar to that of the dipole, the GPS receiver needs a mode-1 pattern covering the upper hemisphere. Thus, this single SMM antenna can serve both cellular and GPS systems simultaneously on a personal or mobile system. The radiation zone of the mode-1 higher-frequency GPS band is in an inner ring of the spiral. The radiation zone of the mode-0 lower-frequency cellular band can be designed to be in an outer ring of the spiral, and the shorting mechanism can be placed at the edge of the spiral serving the cellular band only.

To excite spiral modes of mode-2 and higher, a conventional Butler matrix feed network can be used in conjunction with shorting mechanisms on a four-arm spiral SMM antenna. In fact, such a matrix will excite all four modes—modes-0, 1, 2, and 3. The shorting mechanisms, a total of four with one on each of the four arms, while enhancing mode-0, do not interfere with the other modes if the shorting mechanisms 62*a*, 62*b* are placed outside the radiation zones corresponding with the higher-order spiral modes.

FEED OFF THE CENTER OF THE SPIRAL ANTENNA ELEMENT

Figure 10:
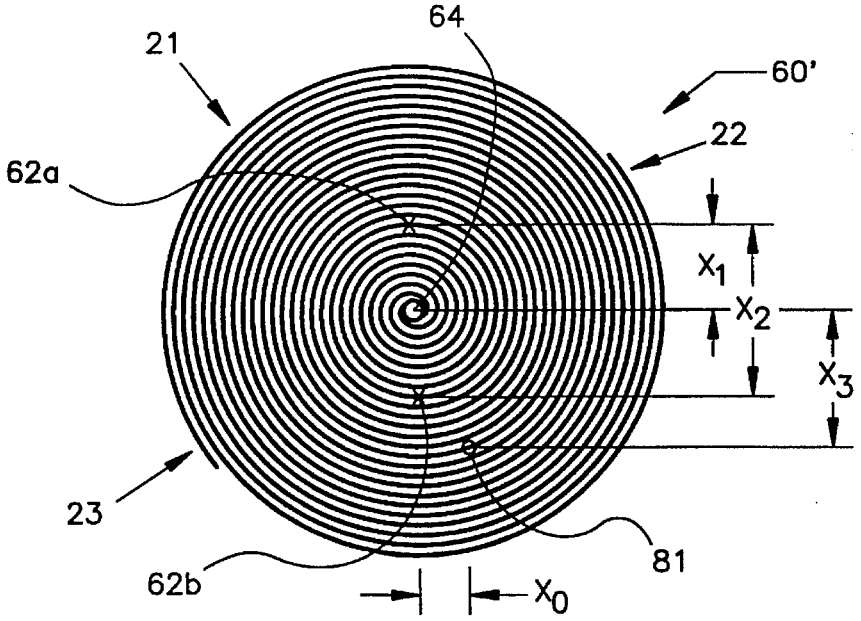
FIG. 10 shows a multifunction SMM antenna using both a center feed point and an off-center feed point.

FIG. 10 shows a second embodiment of an SMM antenna in accordance with the present invention, denoted generally by reference numeral 60'. The construction of the SMM antenna 60' of FIG. 10 is similar to that of the SMM antennas 20, 60 and accordingly, the discussions hereinbefore relative to the SMM antennas 20, 60 are incorporated herein by reference and are equally applicable to the SMM antenna 60'. However, the SMM antenna 60' of FIG. 10 is different in some respects. The SMM antenna 60' has both a center feed point 64 and an off-center feed point 81. In essence, after extensive research, it was discovered by the inventor that the feed point 64 for the SMM antenna 60 of FIG. 6 need not be located at the center of the spiral antenna element 21, though the launching (or reception) of electromagnetic waves while operating in the spiral modes is most easily accomplished starting at the center location.

Furthermore, in the SMM antenna 60', shorting mechanisms 62*a*, 62*b* are disposed well within the bounds of the spiral antenna element 21 for shorting the arms 22, 23 to the underlying ground plane GP (FIG. 1). In this example, the operating frequencies are between about 150 MHz and 1500 MHz. The diameter D of the spiral element 21 was 12 inches to cover the specific frequency range down to about 150 MHz. A larger diameter is needed for even lower frequencies. The thickness d of the SMM antenna 60' in this example was varied in the approximate range of 0.3"<d<2.0" for this frequency range, but clearly thicknesses outside this range are possible, depending upon the particular operating frequencies in the application. Furthermore, the other illustrated dimensional parameters are as follows: $X_0$=0.5", $x_1$=1.5", $x_2$=3.0", and $x_3$=2.8".

Feeding the SMM antenna 60' at several different points, one or more situated at the center 64 and one or more situated away from the center 64, provides for various possible input/output terminals, each of which can be used to connect separate electronic systems. Moreover, the shorting mechanisms 62*a*, 62*b* define the outer boundary of the center feed 64, and the inner boundary of the off-center feed 81. Thus, manipulation of the feed point positions and/or the shorting mechanism positions can serve as a multiplexing technique. The resulting integrated multiplexing has significant advantages in cost, size, weight, etc., over conventional multiplexing networks.

It is sometimes desirable to have a pair of symmetric off-center feeds (not shown) connected in parallel to form a single "balanced" feed. For example, in the SMM antenna 60' of FIG. 10, another off-center feed (not shown) symmetrical the center 64 with respect to feed 81 would be added on the other side of the center feed point 64 of the spiral antenna element 21, also located 2.8" away from the center 64, to feed the other spiral arm 23. These two off-center feeds, 81 and its mirror image about the center 64, would then be connected below the ground plane GP by a feed network appropriate for the specific modes; for example, a simple combiner is used for mode-0, and a balun or a 180° hybrid for mode-1.

The operation of one feed does not interfere with that of another feed as long as their spiral modes do not pass through each other. Multimode and multifunction is facilitated by the fact that the radiation of a spiral mode is concentrated in a circular ring-shaped radiation zone with a radius proportional to the operating wavelength and the mode number. For example, the radiation zone of mode-1 is centered on a circle with a circumference of one wavelength ($\lambda$), and that for mode-2 is at a circumference of two wavelengths ($2\lambda$). That is, the radiation zone for mode m is on a circumference $m\lambda$. It should be further noted that the width, or radial spread, of a radiation zone will be narrower if the spiral windings are tighter and denser.

Therefore, to avoid interference between feeds, one approach is to avoid placing another feed between an existing feed and the radiation zone of the particular spiral mode excited by the existing feed. Another approach is to make the intruding shorting probe non-interfering with respect to the spiral mode of interest by a scheme of frequency or spiral-mode discrimination, or both. In the case of frequency discrimination, a capacitor or inductor can be included in inductor shorting pins so that the pins will act as a shorting mechanism over the desired frequency range and do not interfere with the wave at other designated frequency range. In the case of spiral-mode discrimination, one can take advantage of the fact that the radiation zones for different spiral modes are located on different circumferences. Thus, feeds and shorting mechanisms for one spiral mode can be positioned near its radiation zone and spaced away from other spiral modes and their associated shorts and feeds.

Figure 11:
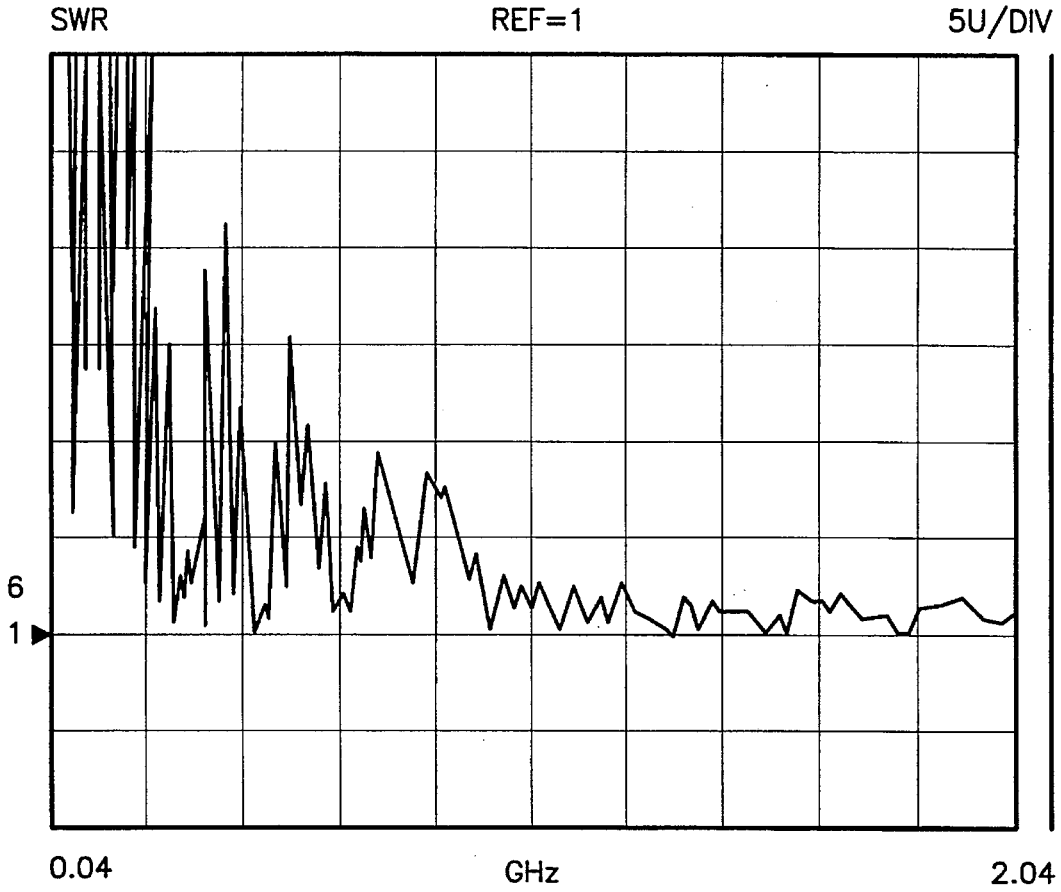
FIG. 11 shows the measured VSWR at the off-center feed of the antenna of FIG. 8 for d=0.375 inch.

Extensive measurements have shown that the off-center feed such as that designated as reference numeral 81 also has a broadband characteristic similar to that of the center feed exemplified by 64. FIG. 11 shows measured VSWR at the off-center feed 81 of the antenna 60' in FIG. 10 for the case of d=0.375". A larger d will yield a lower VSWR across the frequency band, especially at the lower frequencies.

CONCENTRIC GAPS IN SPIRAL ANTENNA ELEMENT TO ENHANCE SPECIFIC SPIRAL MODE RADIATION

It has been demonstrated that electromagnetic wave propagation on an SMM antenna is well supported by the four broadband transmission lines 51–54 shown and described relative to FIG. 5. As a result, impedance matching or matchable impedance at both center and off-center feed points should be achievable with ease. The remaining tasks in antenna design are to make the SMM antenna (1) radiate the desired spiral mode or modes, and (2) radiate efficiently (with minimal dissipative loss); these tasks become difficult when the spacing between the spiral and the ground plane GP is small in wavelength (for instance, less than $0.03\lambda$).

Figure 12:
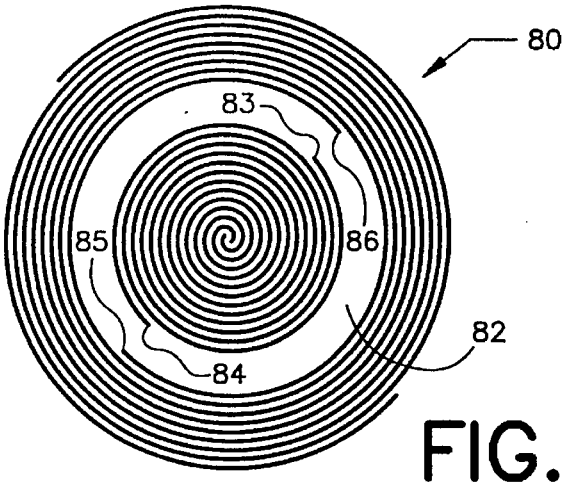
FIG. 12 shows a second embodiment of an SMM antenna of the present invention, which has a concentric gap forming first and second sets of spiralling arms for the purpose of optimizing radiation.

A third embodiment of the present invention is depicted in FIG. 12, and denoted generally as SMM antenna 80. The construction of the SMM antenna 80 is not limited to this specific configuration, but to a general SMM antenna, and therefore can be similar to that of the SMM antennas 20, 60, 60'; accordingly, the discussions hereinbefore relative to the SMM antennas 20, 60, 60' are incorporated herein by reference and are equally applicable to the SMM antenna 80.

By removing a ring-like portion of the spiral arms within the periphery of the spiral antenna element 21, as is shown in FIG. 12, a concentric gap 82 is created in the SMM antenna 80. In essence, in the SMM antenna 80 of FIG. 12, a first plurality of spiral arms 83, 84 is established internally near the antenna center and a second plurality of spiral arms 85, 86 is established concentrically outside the first plurality further away from the antenna center. The concentric gap 82 between the first and second pluralities of spiral arms limits the propagation of the spiral modes to within either the outer or the inner spiral windings. Without the gap 82, a spiral mode could travel extensively, and thus be dissipated, along the spiral windings without much of the intended radiation. With the gap 82, a spiral mode travels within a much reduced radial zone and has more opportunity to radiate each time it passes the appropriate radiation zone.

More than one concentric gap 82 can be placed in a multifunction SMM antenna for more modes or more frequency bands. Shorting mechanisms 62*a*, 62*b* (FIG. 6) can also be placed at the end of the spiral arms at the edge of a gap 82 to enhance the "gap effect." In other words, the patterns associated with each of the discrete arm areas is further isolated by the shorting mechanisms 62*a*, 62*b*.

As an extension of the aforementioned gap technique, radiation efficiency can be improved, at the low end of the operating frequencies where radiation tends to be inefficient, for a narrow bandwidth of operation by removing the total inner windings in FIG. 12, leaving the spiral antenna element with only the outer windings.

EXCITATION OF SPIRAL MODES FOR SUPER-THIN SMM ANTENNA AS A MAGNETIC CURRENT ANTENNA

It is often desirable to reduce the thickness d of an SMM antenna in order to form a super-thin, low profile SMM antenna having a thickness d of less than or equal to about $0.03\lambda_c$, where $\lambda_c$ is the wavelength at the geometric mean frequency between the minimum and maximum operating frequencies.

In the following, we will demonstrate the fact that the SMM antenna is equivalent to a slot antenna as well as a magnetic current antenna, therefore compatible with a ground plane. Next we will point out that in such a super-thin SMM antenna, the modes of the transmission lines 51–54 of FIG. 5 are robust, but radiation becomes difficult and inefficient, and methods to improve the radiation efficiency or antenna gain are needed. The short mechanism, the off-center feed, the concentric gaps, the use of capacitors, inductors and switches in the short mechanism, and the use of superconductor and low-loss dielectric in the structure, are all techniques that can be used to enhance the radiation efficiency of the super-thin SMM antenna. In addition, other techniques can also be derived from the insight that the SMM antenna is a slot antenna, or a magnetic current antenna.

Figure 13A:
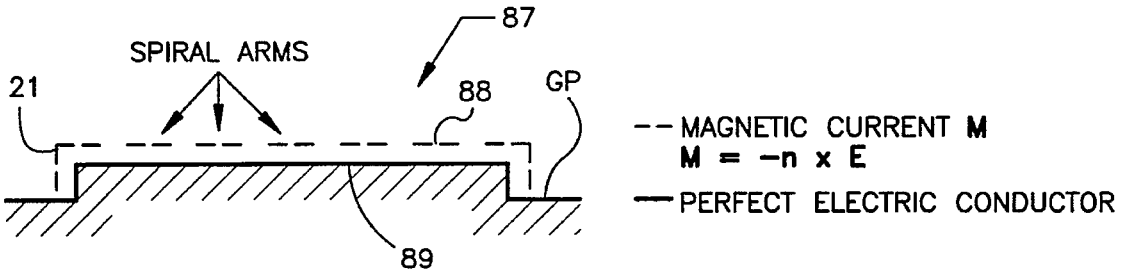
FIGS. 13A and 13B show cross-sectional views for a general SMM antenna and its equivalent magnetic current representation for the half-space above the ground plane.
Figure 13B:
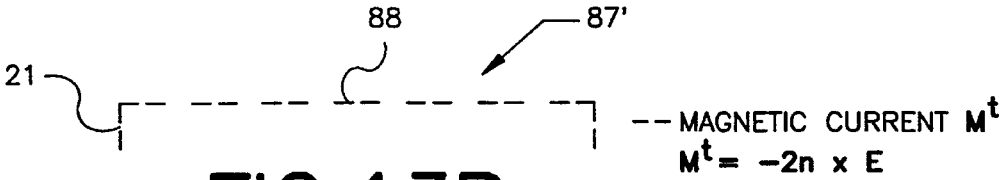

By invoking once again the well known Current Equivalence Principle of electromagnetic theory, an SMM antenna, such as the one of FIG. 6, can be represented as shown by either of the two equivalent models 87, 87' of FIGS. 13A, 13B in cross-sectional view. In the model 87 of FIG. 13A, the SMM antenna is shown as a magnetic current M, denoted by reference numeral 88, immediately above a perfectly conducting surface 89 defined by the physical contour of the SMM antenna. In FIG. 13B, the equivalent SMM antenna 87 of FIG. 13A is further reduced to a surface magnetic current $M^t$ without the conducting surface 89.

These equivalent models 87, 87' are valid only for the half-space above the ground plane GP, which is the space of interest. The magnetic current M, denoted by reference numeral 88, in the model 87 of FIG. 13A, equals $-n\times E$, where n is an outwardly pointed unit vector normal to the contour surface of the SMM antenna, and E is the electric field at that point. Note that E, n, M and $M^t$ are all functions of position. Since the tangential electric field on a perfectly conducting surface must vanish, the magnetic current M exists only at the gaps between spiral arms 22, 23 and at the end region around the spiral antenna element 21, where the surface is not conducting. Thus, the SMM antenna can also be viewed as a slot antenna 52 (FIG. 5B).

The model 87' of FIG. 13B simply follows the model 87 of FIG. 13A since, by the Image Theorem of basic electromagnetics theory, a magnetic current parallel and adjacent to a perfectly conducting surface is equivalent to itself plus its mirror image on the other side of the conducting surface with the conducting surface removed. Thus, the magnetic current M immediately over a perfect conductor can be replaced by a magnetic current $M^t$ alone, where $M^t=-2n\times E=2M$, as shown in FIG. 13B. Thus, the tangential magnetic current is compatible with a parallel conducting surface; when they approach each other, the magnitude of the magnetic current doubles, and the conducting surface is removed.

On the other hand, an electric current parallel to a conducting surface induces a mirror image current of the opposite sense; as a result, the net electric current approaches zero (due to cancellation of the current and its image current) when an electric current nears a parallel conducting surface. This is why a super-thin low-profile antenna must be of the magnetic current type, not the electric current type. Magnetic currents and charges are fictitious and do not exist in reality as electric currents and charges do. The slot antenna is an equivalent magnetic current source.

Besides the slot antenna, the microstrip patch antenna and the SMM antenna are the only other known super-thin low-profile antennas. Actually, both the microstrip patch antenna and the SMM antennas can be modelled as slot antennas (or magnetic current antennas), as has been discussed. The microstrip patch antenna is narrowband because it is a resonant structure. The SMM antenna is broadband because it is nonresonant. However, a super-thin, mode-0 SMM antenna may be narrowband, if it is strictly defined by the location of the shorting mechanisms or the diameter defining the distinct edge of the spiral arms. Therefore, any method that broadens the effective range of location for the shorting mechanisms can potentially broaden the bandwidth of mode-0 operation.

Radiation of mode-1 or higher is from the magnetic current (or slot) between spiral arms and therefore have unrestricted radiation areas, unless the radiation zones are at the edge of the spiral antenna element 21. As a result, the radiation of mode-1 or higher is easier to accomplish than that of mode-0 as long as the spiral diameter D is sufficiently large to encompass the radiation zone of the specific spiral mode of interest.

Figure 14A:
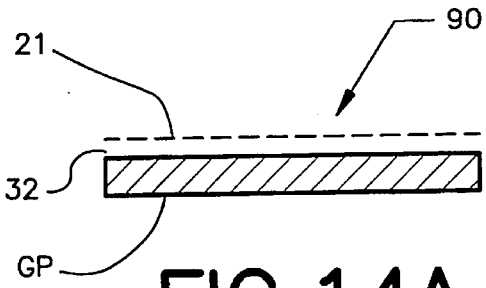
FIGS. 14A and 14B show a disk-shaped SMM antenna and its equivalent magnetic current antenna, respectively.
Figure 14B:
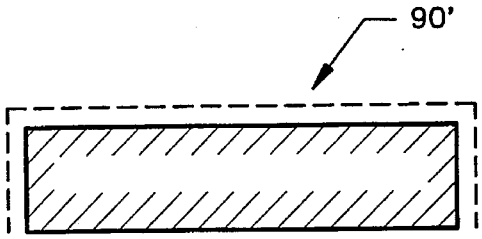

As an extension of this concept, the ground plane GP beyond the periphery of the spiral antenna element 21 can be removed, resulting in the super-thin, disk-shaped SMM antenna 90 shown in FIG. 14A, which constitutes a fourth embodiment of the present invention. The construction of the SMM antenna 90 of FIG. 14A is similar to other SMM antennas such as 20, 60, 60', 80, and accordingly, the discussions hereinbefore relative to the SMM antennas 20, 60, 60', 80 are incorporated herein by reference and are equally applicable to the SMM antenna 90. However, the SMM antenna 90 of FIG. 14A is different in at least one very significant respect. As mentioned, the thickness d of the disk-shaped SMM antenna 90 is super-thin, measuring less than about $0.03\lambda_c$, where $\lambda_c$ is the wavelength at the geometric mean frequency between the minimum and maximum operating frequencies. Moreover, the spiral diameter D of the antenna element 21 can have a broad dimensional range, depending upon the application. The equivalent magnetic current antenna 90' over a conducting surface, being the same as that in FIG. 13A, is shown in FIG. 14B, which is essentially valid anywhere throughout the entire space outside the SMM antenna 90.

The super-thin disk-shaped SMM antenna 90 is of practical importance for applications in which it is desirable either to have a small and thin antenna or to "paste" an antenna on a physically small structure, such as a hand-held cellular phone or briefcase-shaped electronic equipment, over a narrow frequency range.

Figure 15:
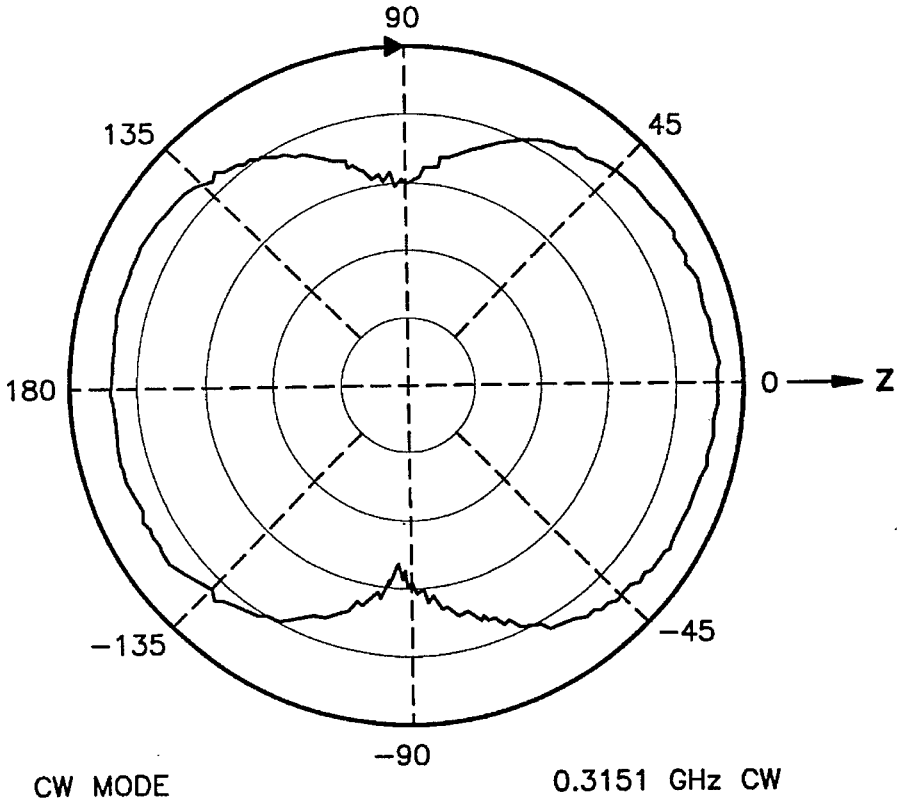
FIG. 15 shows the measured radiation pattern at 315 MHz for the antenna of FIG. 14 with d=0.375 inch and with the ground plane truncated to 12 inches.

FIG. 15 shows the measured elevation pattern (vertical polarization) at 315 MHz for the super-thin SMM antenna 90 of FIG. 14A with d=0.375" (or $0.01\lambda_c$), spiral diameter D=12", with the ground plane GP also truncated to 12" in diameter. By the Frequency Scaling Principle in antenna theory, this disk-shaped antenna 90 can be reduced to 4.4" dia×0.14" thick for the U.S. cellular band (800–900 MHz), and to 2.2" dia×0.07" thick for the European cellular band (around 1600 MHz) and for the Iridium Personal Communications System (approximately 1600 MHz).

It is worth pointing out that the ground plane GP can be of any other finite size as long as it is not smaller than the spiral antenna element 21, even though the performance of the SMM antenna 90 will depend to some extent on the size and shape of the finite ground plane GP.

USE OF SUPERCONDUCTOR AND LOW-LOSS DIELECTRIC SUBSTRATE TO EHNHANCE RADIATION EFFICIENCY IN A SUPER-THIN SMM ANTENNA

The impedance of the SMM antenna, whether center fed or off-center fed, whether using shorting mechanisms 62A, 62B or not, is usually well matched or readily matchable over a rather wide bandwidth, even when it is super-thin (thickness being less than about 0.03 wavelength). However, the electric efficiency, and the associated gain, of the super-thin antenna decreases as the antenna becomes thinner, especially for mode-0. This disposition means that the radiation becomes inefficient and the waves corresponding to spiral modes travel back and forth on the SMM structure, and being gradually dissipated, in one or more of the four transmission line models 51–54 shown in FIG. 5 without much of the desired radiation. Now, by using a superconductor for the spiral antenna element 21 and the ground plane GP, and by using a thin and low-loss dielectric substrate 32 (FIG. 1; or any supporting dielectric structure), the dissipation incurred along the SMM antenna structure can be minimized and the radiation efficiency enhanced.

USE OF CAPACITORS, INDUCTOR AND/OR DIODES ON THE SPIRAL ARMS AND SHORTING PINS FOR FREQUENCY MULTIPLEXING AND PERFORMANCE ENHANCEMENT

Wave propagation in the SMM antennas 20, 60, 60', 80, 90 can be controlled by the use of lumped or distributed capacitors and/or inductors for frequency multiplexing, in accordance with the insight of the four transmission line models 51–54 of FIG. 5. A properly chosen capacitor blocks waves below a certain frequency and allows waves of higher frequency to pass. It is necessary, however, that the desired pass-band and stop-band be separated sufficiently wide apart for effective, noninterfering pass-band and stop-band actions. An inductor operates in a similar, though opposite, manner in frequency blocking or passing.

A potential benefit of using capacitor/inductor in the spiral arms 22, 23 and shorting mechanisms 62*a*, 62*b* (FIGS. 6A, 6B) is that the antenna performance can be altered and tailored for a specific application. Electric and magnetic currents, as well as impedance, can be changed by selected capacitors and inductors applied at the proper locations.

Similarly, electric or mechanical switches can be inserted in the shorting mechanisms to turn on or off the short mechanism on a real-time basis. If the switching is fast enough, each shorting mechanism can be activated for different signals encompassing simultaneously a wide frequency band, therefore, in effect, broadening the bandwidth of the antenna. If the switching is slow, the antenna can be made to cover different systems with different operating frequencies, though not simultaneously. The switching mechanisms are adaptable with various systems such as the TDMA (Time Division Multiple Access) or FDMA (Frequency Division Multiple Access) systems used in cellular phone systems.

It should be noted that although some discussions hereinbefore may appear to be limited to either a transmit or a receive function, they are equally applicable to both the transmit and receive function because of the Reciprocity Theorem in electromagnetic theory. Moreover, unless non-reciprocal components are used in the feed networks, the SMM antenna is a reciprocal antenna, and functions equally well as a transmit or receive antenna, or both.

It should be further noted that it will be obvious to those skilled in the art that many modifications and variations may be made to the preferred embodiments of the present invention, as set forth above, without departing substantially from the principles of the present invention. Along these lines, the basic design methods described in this document can be applied to other groups of wireless electronic systems with different performance requirements such as frequencies of operation and pattern coverage.

It must be emphasized that all the techniques and design configurations must be implemented with ample care in impedance matching to facilitate wave propagation from the feed network to the antenna structure and to free space.

By applying the well established Frequency Scaling Theory in antenna design, one can vary the design simply by scaling up or down the antenna dimensions, and sometimes the dielectric constants if plastics are used, to come up with a design for different frequencies of operation. For example, if it is desired to receive VHF and/or UHF television broadcast, either on a narrowband or broadband basis, one can scale up in size an SMM antenna designed for the higher cellular frequencies. A larger antenna, which can be accommodated on a van, truck, or train, will be capable of reception and transmission at lower frequencies. As another example, if it is desired to cover higher frequencies, a smaller SMM antenna can be used. All such modifications and variations which utilize principles of the present invention are intended to be included herein within the scope of the present invention.

Wherefore, the following is claimed:

1. A spiral-mode microstrip antenna having a desired radiation pattern at specific angles about the antenna, comprising:

a ground plane element;

a spiral-mode antenna element having a plurality of arms extending outwardly in a plane from a central portion, said arms having respective feed points, said antenna element being generally parallel to and spaced from said ground plane element by a distance, said antenna element being capable of supporting one or more spiral mode excitation patterns; and means for affecting the shape of said spiral mode patterns with a desired peak gain at specific angles with respect to said ground plane element, said means comprising a shorting mechanism connecting an arm to said ground plane element at a desirable location along the length of said arm and distinguishable from a feed point associated with said arm.

2. The antenna of claim 1, wherein said shorting mechanism is a conductive pin.

3. The antenna of claim 1, wherein said shorting mechanism comprises a capacitor.

4. The antenna of claim 1, wherein said shorting mechanism comprises an inductor.

5. The antenna of claim 1, wherein said shorting mechanism comprises a diode.

6. The antenna of claim 1, wherein said shorting mechanism comprises a switch for switching electrical connection of said arm to said ground plane element.

7. The antenna of claim 1, wherein said distance is less than or equal to $0.03\lambda_c$, where $\lambda_c$ is the wavelength at the geometric mean frequency between the minimum and maximum operating frequencies.

8. The antenna of claim 1, wherein said shorting mechanism is disposed along said arm so that gain at angles near said ground plane element is increased in a mode-0 operation.

9. The antenna of claim 1, further comprising another shorting mechanism and wherein said shorting mechanism and said another shorting mechanism on each arm are spaced at unequal distances away from said central portion of said antenna element.

10. The antenna of claim 1, wherein a feed point of one of said arms is situated away from said central portion.

11. The antenna of claim 1, wherein said arms are made of superconducting material.

12. A spiral-mode microstrip antenna for optimizing radiation patterns for a plurality of operational spiral modes, comprising:

a ground plane element;

an antenna element having first and second antenna portions separated by a gap, said first antenna portion having a first plurality of arms extending outwardly from a central portion of said antenna element within a plane, said arms having respective feed points, said plane being generally parallel to and spaced apart from said ground plane element by a distance, said antenna element having an electromagnetic radiation pattern associated therewith when excited in a specific spiral mode, and said second antenna portion being within said plane and separated from said first antenna portion by said gap, said second antenna portion having a second plurality of arms spiraling outwardly away from said central portion within said plane, said second antenna portion having respective feed points different from said respective feed points of said first antenna portion.

13. The antenna of claim 12, wherein said arms are made of a superconducting material.

14. A super-thin spiral-mode microstrip antenna for low-profile applications, comprising:

a ground plane element;

an antenna element having a plurality of arms extending outwardly in a plane from a central portion, said arms having respective feed points, said plane being generally parallel to and spaced from said ground plane element by a distance, said distance being less than $0.02\lambda_c$, where $\lambda_c$ is the wavelength at the geometric mean frequency between the minimum and maximum operating frequencies; and a shorting mechanism connecting an arm to said ground plane element, whereby said shorting mechanism affects the shape of an electromagnetic radiation pattern associated with a spiral mode of said antenna.

15. The antenna of claim 14, further comprising a substrate positioned between said antenna element and said ground plane element, said substrate having a low dielectric constant, and wherein said shorting mechanism passes through said substrate.

16. The antenna of claim 14, wherein a feed point of one of said arms is situated away from said central portion.

17. The antenna of claim 14, wherein said arms spiral about each other and wherein said antenna element further comprises a gap which is concentric about said central portion and which is devoid of said arms.

18. The antenna of claim 14, wherein said arms are made of superconducting material.

19. The antenna of claim 14, wherein said shorting mechanism is a conductive pin.

20. The antenna of claim 14 wherein said shorting mechanism comprises a capacitor.

21. The antenna of claim 14, wherein said shorting mechanism comprises an inductor.

22. The antenna of claim 14, wherein said shorting mechanism comprises a diode.

23. The antenna of claim 14, wherein said shorting mechanism comprises a switch for switching electrical connection of said arm to said ground plane element.

24. A method for forming a spiral mode microstrip antenna with optimized gain at a specific angular location about the microstrip antenna, comprising the steps of:

creating a ground plane element;

forming a frequency independent antenna element having a plurality of arms extending outwardly in a plane from a central portion, said arms having respective feed points, said plane being generally parallel to and spaced from said ground plane element, said antenna element having an associated electromagnetic excitation pattern for a specific spiral mode of operation; and connecting an arm of said antenna element with said ground plane element at a location along said arm and distinguishable from a feed point associated with said arm.

25. A method for creating a spiral mode microstrip antenna with optimized radiation patterns for a plurality of operational modes, comprising the steps of:

creating a ground plane element;

producing a first antenna element having a first plurality of arms spiraling outwardly from a central portion of said first antenna element within a plane, said arms having first respective feed points, said plane being generally parallel to and spaced apart from said ground plane element by a distance, said antenna element having an electromagnetic radiation pattern associated therewith when excited during a mode of operation;

forming a second antenna element within said plane and separated from said first antenna element, said second antenna element having a second plurality of arms spiraling outwardly from said central portion within said plane, and said second antenna element having second respective feed points different from said first feed points; and connecting one said arm of one of said first and second plurality of arms with said ground plane element at a location along said arm and distinguishable from said first and second feed points.

26. The method of claim 25, wherein said distance being less than or equal to $0.02\lambda_c$, where $\lambda_c$ is the wavelength at the geometric mean frequency between the minimum and maximum operating frequencies.

* * * * *